US007034266B1

(12) United States Patent
DeGroot et al.

(10) Patent No.: US 7,034,266 B1
(45) Date of Patent: Apr. 25, 2006

(54) TUNABLE MICROWAVE APPARATUS

(75) Inventors: Dennis J. DeGroot, Appleton, WI (US); James A. Boldra, Menasha, WI (US); Keith R. Haen, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 11/117,601

(22) Filed: Apr. 27, 2005

(51) Int. Cl.
*H05B 6/74* (2006.01)
*H05B 6/78* (2006.01)

(52) U.S. Cl. ..... 219/700; 219/695; 219/750; 219/751; 219/756; 333/232; 333/233; 333/224

(58) Field of Classification Search ..... 219/746–751, 219/695–701, 756, 762; 333/231–233, 223–226
See application file for complete search history.

(56) References Cited

U.S. PATENT DOCUMENTS 3,665,141 A 5/1972 Schiffmann et al.
3,673,370 A 6/1972 Johnson
3,715,555 A 2/1973 Johnson
3,748,604 A 7/1973 Wang
3,774,003 A 11/1973 Kaufman, Jr. et al.
4,037,182 A 7/1977 Burnett et al.
4,110,686 A 8/1978 Leskovar et al.
4,127,834 A 11/1978 Stringfellow et al.
4,156,860 A 5/1979 Atia et al.
4,157,515 A 6/1979 De Bayser et al.
4,275,283 A 6/1981 Focht
4,324,965 A 4/1982 Naumann et al.
4,484,162 A 11/1984 Kamada et al.
4,488,027 A 12/1984 Dudley et al.
4,518,932 A 5/1985 Pickering
4,521,754 A 6/1985 Ranghelli et al.
4,642,523 A 2/1987 Nakanishi et al.
4,677,403 A 6/1987 Kich
4,700,146 A 10/1987 Barton
4,714,812 A 12/1987 Haagensen et al.
4,777,336 A 10/1988 Asmussen
4,792,772 A 12/1988 Asmussen
4,831,341 A 5/1989 Brady
4,855,695 A 8/1989 Samardzija
4,940,464 A 7/1990 Van Gompel et al.
4,991,539 A 2/1991 Sarda
5,038,713 A 8/1991 Kawakami et al.
5,087,895 A 2/1992 Sigmon
5,119,051 A 6/1992 Myer
5,146,058 A 9/1992 Herfindahl et al.
5,153,406 A 10/1992 Smith
5,160,819 A 11/1992 Ball et al.
5,191,182 A 3/1993 Gelorme et al.
5,243,310 A 9/1993 Calco
5,250,773 A 10/1993 Lind et al.
5,309,129 A 5/1994 Arnold et al.
5,311,200 A 5/1994 Walker et al.
5,374,911 A 12/1994 Kich et al.

(Continued)

FOREIGN PATENT DOCUMENTS

GB 1 381 727 A 1/1975

(Continued)

*Primary Examiner*—Philip H. Leung
(74) *Attorney, Agent, or Firm*—John L. Brodersen

(57) ABSTRACT

Disclosed is a method and apparatus for tuning a microwave apparatus. The chamber volume of the microwave apparatus can be changed by moving a flexible portion of a flexible wall while a perimeter portion of the flexible wall remains fixed.

20 Claims, 4 Drawing Sheets

U.S. PATENT DOCUMENTS

| | | | | |
|---|---|---|---|---|
| 5,410,283 | A | 4/1995 | Gooray et al. | |
| 5,465,047 | A | 11/1995 | Nakanishi et al. | |
| 5,536,921 | A | 7/1996 | Hedrick et al. | |
| 5,537,002 | A | 7/1996 | Price et al. | |
| 5,691,677 | A | 11/1997 | De Maron et al. | |
| 5,827,259 | A | 10/1998 | Laux et al. | |
| 5,837,978 | A | 11/1998 | Hatzakis, Jr. et al. | |
| 5,853,402 | A | 12/1998 | Faulks et al. | |
| 5,867,077 | A | 2/1999 | Lundquist | |
| 5,869,817 | A | 2/1999 | Zietlow et al. | |
| 5,916,203 | A | 6/1999 | Brandon et al. | |
| 5,977,849 | A | 11/1999 | Hsing et al. | |
| 5,986,526 | A | 11/1999 | Kopal et al. | |
| 6,002,310 | A | 12/1999 | Kich et al. | |
| 6,020,579 | A | 2/2000 | Lewis et al. | |
| 6,020,580 | A | 2/2000 | Lewis et al. | |
| 6,057,645 | A | 5/2000 | Srivastava et al. | |
| 6,118,356 | A | 9/2000 | Loi et al. | |
| 6,163,112 | A | 12/2000 | Ponard et al. | |
| 6,169,468 | B1 | 1/2001 | Chavez | |
| 6,259,077 | B1 * | 7/2001 | Drozd et al. | 219/696 |
| 6,323,470 | B1 | 11/2001 | Schmidt et al. | |
| 6,433,656 | B1 | 8/2002 | Wolk et al. | |
| 6,645,190 | B1 | 11/2003 | Olson et al. | |

FOREIGN PATENT DOCUMENTS

| | | | | |
|---|---|---|---|---|
| GB | 1 398 850 | A | 6/1975 | |
| JP | 52-72953 | * | 6/1977 | 219/745 |
| JP | 04-252602 | A | 9/1992 | |
| WO | WO 93/24969 | A1 | 12/1993 | |

* cited by examiner

TUNABLE MICROWAVE APPARATUS

BACKGROUND OF THE INVENTION

The present invention relates to an apparatus for applying high-frequency electromagnetic energy, such as microwave energy, to a material and methods for tuning such an apparatus. More specifically, the invention relates to a microwave apparatus configured to apply microwave energy to a continuously moving web, and a method for tuning the microwave apparatus.

Apparatus that are designed to apply high frequency electromagnetic energy, such as microwave energy, to materials are known in the art. It is generally advantageous to be able to tune these apparatus such that they may be used to more efficiently process the materials without damaging or burning the material. Generally microwave apparatus are tuned by adjusting appointed tuning components in a conventional, iterative manner to maximize the energy absorbed into the load (i.e., the target material), and to minimize the reflected energy. Accordingly, the tuning components (such as an aperture plate or stub tuner) can be systematically varied to maximize the energy absorbed into the load and minimize the reflected energy.

Nonetheless, tuning of the microwave apparatus can become more challenging in industrial settings where it may be desirable to have a high-speed converting process continuously pass materials through such an apparatus. In such a situation, changes to the material passing through the apparatus can make it desirable or necessary to regularly tune the apparatus to accommodate these changes, especially if the material is prone to burn or combust. Accordingly, certain methods and apparatus have been developed to tune microwave devices that are suitable for such industrial settings.

Unfortunately, in certain circumstances, such methods and apparatus have not been completely satisfactory. For example, one way of tuning the apparatus is to change the volume inside the chamber where the material is exposed to energy. However, these methods typically employ components of the apparatus being in moving contact with each other. This approach in many instances can lead to gapping between the moving components which in turn can undesirably lead to arcing within the chamber. Such arcing can cause the target material to scorch or combust. Moreover, depending on the arrangement of the moving components, the movement of the components of the microwave apparatus can undesirably shift the focus of the energy field from the path of the material through the apparatus.

Thus, there is a need for a microwave apparatus and method that does not rely on components of the apparatus being in moving contact with each other. Further, there is a need for a microwave method and apparatus that provides for the tuning of the apparatus while maintaining the energy field focused on the target material.

SUMMARY OF THE INVENTION

In one aspect, the present invention is directed to a microwave apparatus including an electromagnetic energy source and a chamber operatively connected to the electromagnetic energy source. The chamber defines a chamber volume and includes a static wall portion and a flexible wall. The flexible wall defines a flexible portion and a perimeter portion, where the perimeter portion is statically joined to the static wall portion. The microwave apparatus also includes an actuator operatively connected to the flexible portion. The actuator is configured to move the flexible portion and change the chamber volume.

In another aspect, the present invention is directed to a method for processing a material with microwave energy including feeding a material into a chamber. The chamber defines a chamber volume and includes a static wall and a flexible wall defining a flexible portion and a perimeter portion. The method also includes exposing the material to microwave energy within the chamber and moving the flexible portion while the perimeter portion remains fixed to the static wall portion, thereby changing the chamber volume.

In yet another aspect, the present invention is directed to a method of tuning a microwave apparatus including providing a chamber for exposing materials to microwave energy. The chamber defines a chamber volume, a material path through the chamber volume and includes at least one flexible wall. The method further includes changing the chamber volume by moving the flexible wall such that the chamber volume remains symmetrical about the material path.

The above-mentioned and other aspects of the present invention will become more apparent, and the invention itself will be better understood by reference to the drawings and the following description of the drawings.

BRIEF DESCRIPTION OF THE DRAWINGS

Corresponding reference characters indicate corresponding parts throughout the drawings.

Definitions

Figure 1:
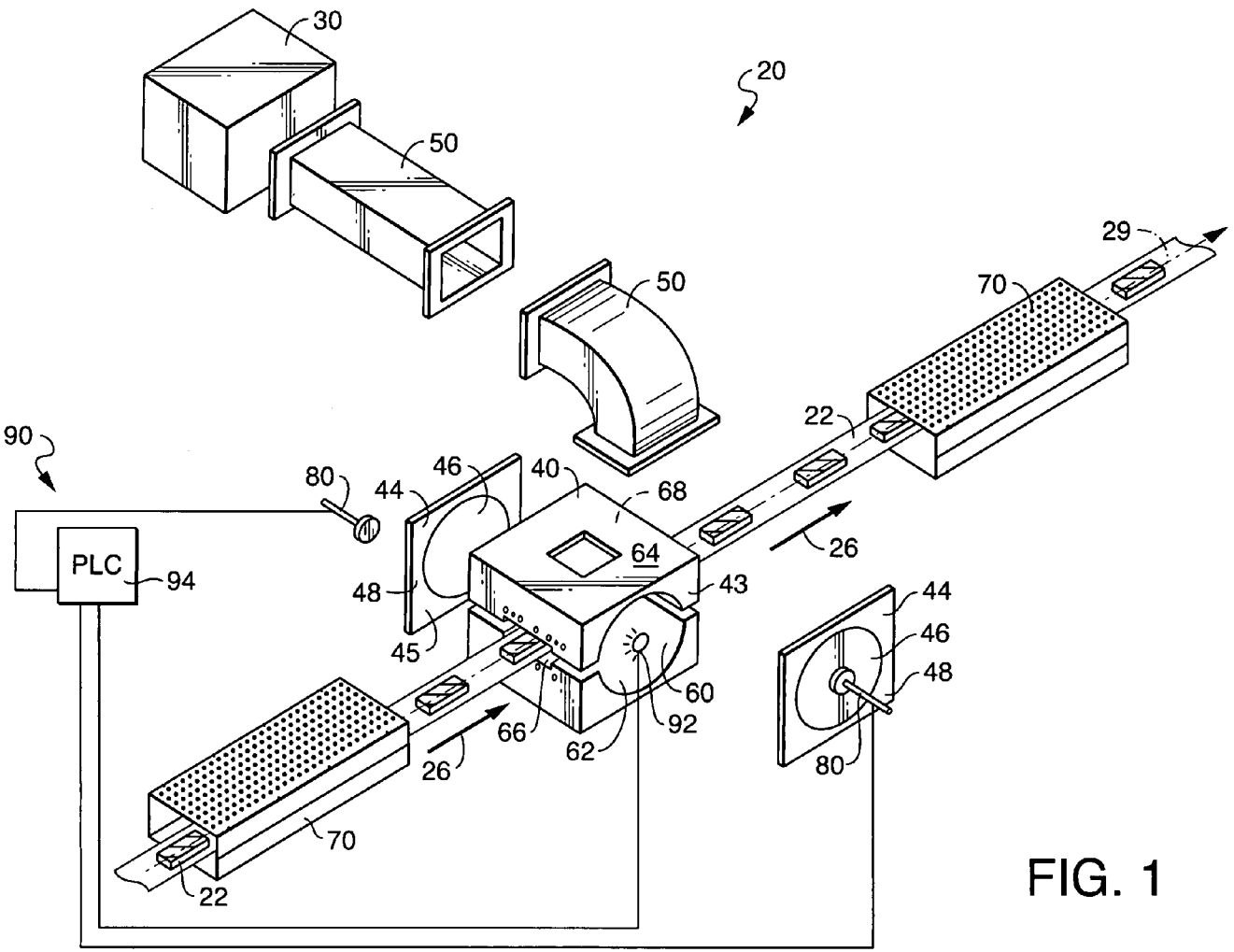
FIG. 1 representatively illustrates an exploded perspective view of a microwave apparatus and method for processing materials with microwave energy according to the present invention.

Within the context of this specification, each term or phrase below includes the following meaning or meanings:

"Attach" and its derivatives refer to the joining, adhering, connecting, bonding, sewing together, or the like, of two elements. Two elements will be considered to be attached together when they are integral with one another or attached directly to one another or indirectly to one another, such as when each is directly attached to intermediate elements. "Attach" and its derivatives include permanent, releasable, or refastenable attachment.

"Connect" and its derivatives refer to the joining, adhering, bonding, attaching, sewing together, or the like, of two elements. Two elements will be considered to be connected together when they are integral with one another or connected directly to one another or indirectly to one another, such as when each is directly connected to intermediate elements. "Connect" and its derivatives include permanent, releasable, or refastenable connection. In addition, the connecting can be completed either during the manufacturing process or by the end user.

"Dielectric Constant" measures the ability of a relatively non-conductive material to store electric potential energy while under the influence of an electric field. The constant is equal to the ratio of the capacitance of a capacitor filled with the given material to the capacitance of an identical capacitor in a vacuum without the dielectric material.

"Disposable" refers to articles which are designed to be discarded after a limited use rather than being laundered or otherwise restored for reuse.

The terms "disposed on," "disposed along," "disposed with," or "disposed toward" and variations thereof are intended to mean that one element can be integral with another element, or that one element can be a separate structure bonded to or placed with or placed near another element.

"Fiber" refers to a continuous or discontinuous member having a high ratio of length to diameter or width. Thus, a fiber may be a filament, a thread, a strand, a yarn, or any other member or combination of these members.

"Join" and its derivatives refer to the attaching, adhering, connecting, bonding, sewing together, or the like, of two elements. Two elements will be considered to be joined together when they are integral with one another or attached directly to one another or indirectly to one another, such as when each is directly attached to intermediate elements. "Join" and its derivatives include permanent, releasable, or refastenable joinder.

"Layer" when used in the singular can have the dual meaning of a single element or a plurality of elements.

"Member" when used in the singular can have the dual meaning of a single element or a plurality of elements.

"Nonwoven" and "nonwoven web" refer to materials and webs of material that are formed without the aid of a textile weaving or knitting process. For example, nonwoven materials, fabrics or webs have been formed from many processes such as, for example, meltblowing processes, spunbonding processes, air laying processes, and bonded carded web processes.

"Operatively Connected" refers to the relationship of two elements whereby they may each suitably function and interact with each other as intended, but they may or may not be physically contacting one another directly or indirectly.

"Superabsorbent material" refers to a water-swellable, water-insoluble organic or inorganic material capable, under the most favorable conditions, of absorbing at least about ten times its weight and, more desirably, at least about thirty times its weight in an aqueous solution containing about 0.9 weight percent sodium chloride.

These terms may be defined with additional language in the remaining portions of the specification.

DETAILED DESCRIPTION

The present invention concerns a microwave apparatus and a method for processing materials with microwave energy. More specifically the present invention is directed to a microwave apparatus suitable for applying microwave energy to a web of material, where the web of material can contain multiple materials having different dielectric characteristics, such as absorbent materials, and a method for processing such materials with microwave energy. As such, the present invention will be described in terms of an apparatus and method for applying microwave energy to a web of absorbent material. Nonetheless, it will be understood by those of skill in the art that that the apparatus and method of the present invention will be equally adaptable for applying microwave energy to other materials and material configurations.

Referring now to the drawings and in particular to FIG. 1, there is representatively illustrated an exploded perspective view of a microwave apparatus of the present invention, generally indicated at 20. Microwave apparatus are generally well known in the art, and are described, for example, in U.S. Pat. No. 6,020,579 issued Feb. 1, 2000 to Lewis, et al., which is incorporated herein by reference to the extent that it is consistent (i.e., not in conflict) herewith. The apparatus 20 includes an electromagnetic energy source 30 and a chamber 40. The electromagnetic energy source 30 may be joined to the chamber by way of a wave guide 50.

The microwave apparatus 20 of the present invention is suitably a tunable microwave device. That is, the apparatus 20 can be adjusted such that the radio-frequency energy is present within the chamber 40 in an operative standing wave. As mentioned above, microwave apparatus can be tuned by adjusting appointed components in an iterative manner to maximize the energy absorbed by a target material 22, and to minimize any reflected energy. In a particular feature, the apparatus 20 can be configured such that the energy resonates within the chamber 40. As such, the energy waves will build upon themselves rather than having the energy waves dampen themselves out.

Examples of suitable arrangements for a resonant, tunable microwave system are described in U.S. Pat. No. 5,536,921 issued Jul. 16, 1996 to Hedrick et al.; and in U.S. Pat. No. 5,916,203 issued Jun. 29, 1999 to Brandon et al., each of which are incorporated herein by reference to the extent that they are consistent (i.e., not in conflict) herewith.

Figure 2:
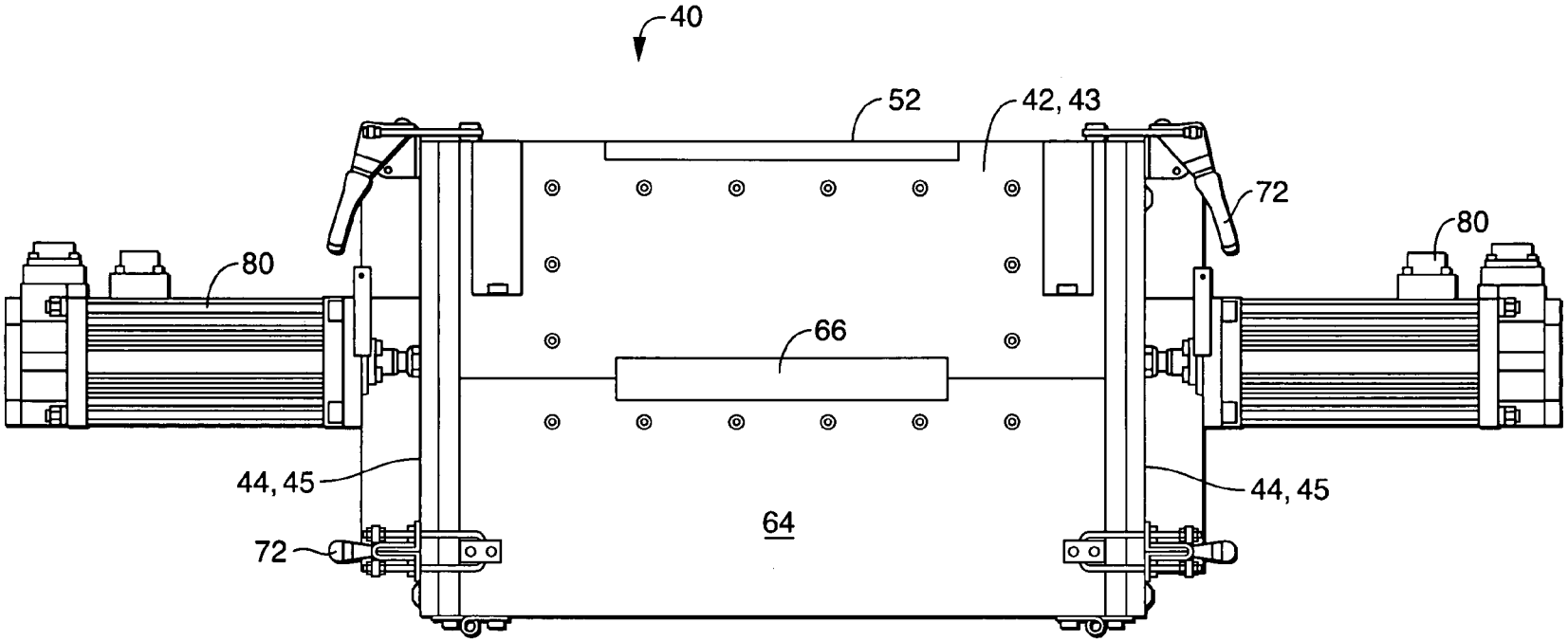
FIG. 2 representatively illustrates an elevation view of a portion of a microwave apparatus and method of the present invention, showing the material inlet of the microwave apparatus.
Figure 3:
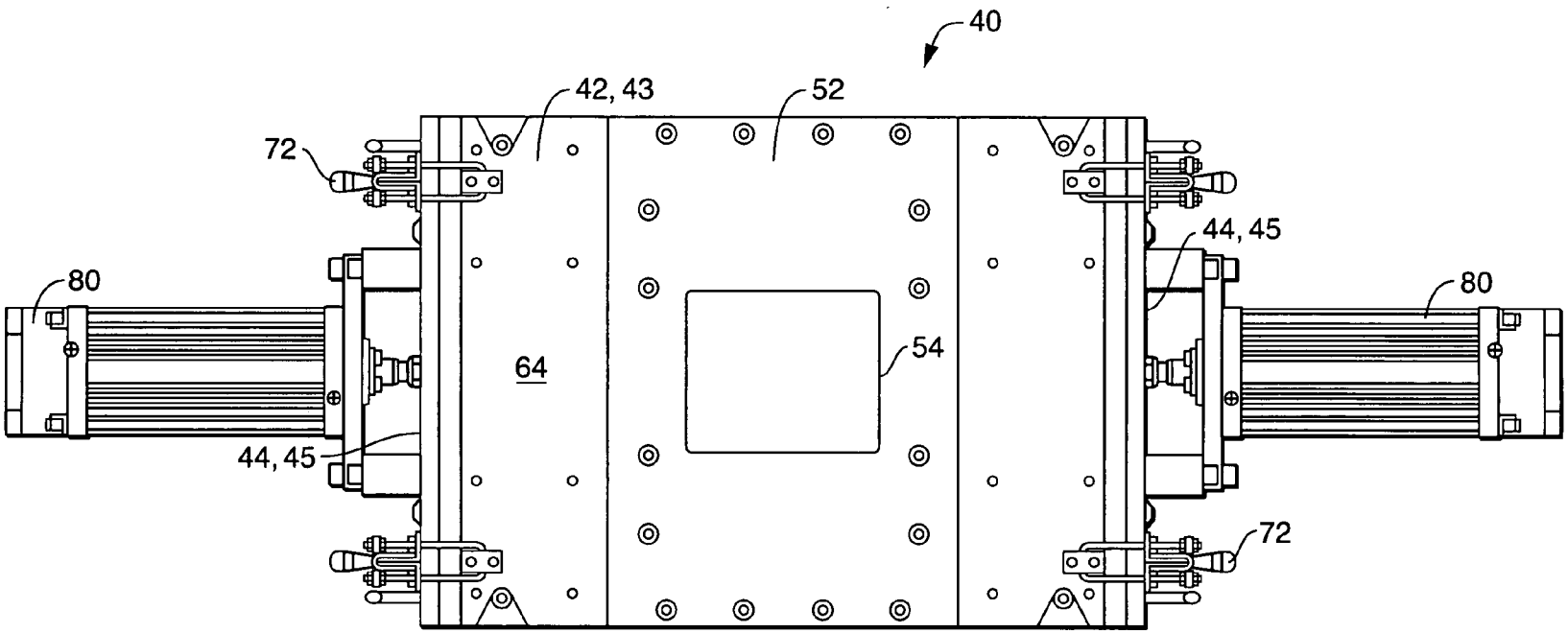
FIG. 3 representatively illustrates a top view of the portion of the microwave apparatus of FIG. 2.
Figure 4:
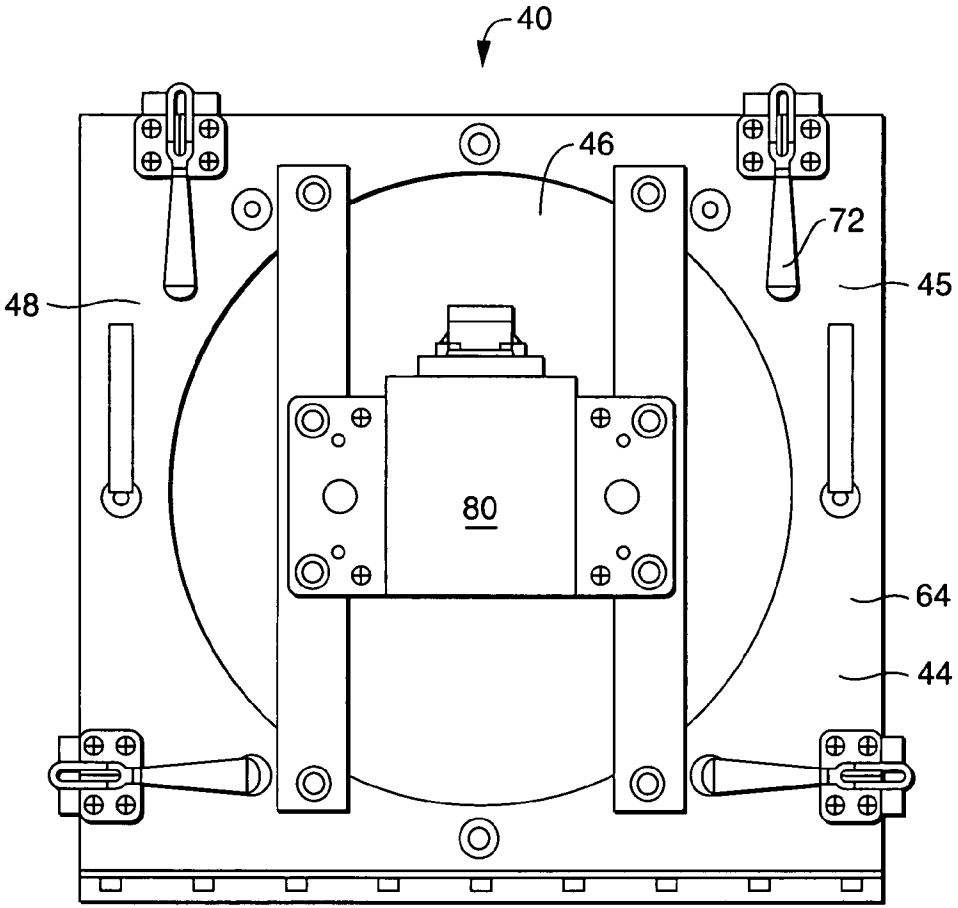
FIG. 4 representatively illustrates a right side view of the portion of the microwave apparatus of FIG. 2.

Turning now to FIG. 2, there is representatively illustrated an elevation view of a portion of the apparatus 20 of the present invention, and shows a material inlet 66 in the chamber 40. FIG. 3 representatively illustrates a top view of the chamber 40 of FIG. 2, and FIG. 4 representatively illustrates a side view of the chamber 40 of FIG. 2.

The electromagnetic energy source 30 can be configured to provide high-frequency, electromagnetic, radiant energy for the apparatus 20. In particular, the electromagnetic energy source 30 can provide radio-frequency (RF) energy having an RF frequency which is at least about 300 megahertz (MHz). The frequency can alternatively be at least about 915 MHz to provide improved performance. In other aspects, the frequency can be up to about 300,000 MHz or more. The frequency can alternatively be up to about 30,000 MHz, and can optionally be up to about 2,450 MHz to provide desired effectiveness. Generally, it is understood by those of ordinary skill in the art that an energy source providing energy at an RF frequency of about 500 MHz and above is commonly viewed as a microwave energy source.

Thus, the electromagnetic energy source 30 of the method and apparatus of the present invention can be a generator that is capable of providing an operative amount of RF energy at a desired frequency. In use, that energy can be directed through a suitable wave-guide 50 to the chamber 40. Suitable generators that may be used as the energy source 30 of the present invention are well known in the art. In particular, suitable generators are available from Richardson Electronics, LTD., having offices in LaFox, Ill.

As mentioned above, the energy from the energy source 30 may be channeled to the chamber 40 by way of a wave guide 50. Specifically, the chamber 40 can be operatively connected to the energy source 30 by way of the wave guide 50, such that the desired amount of energy may be suitably directed into the chamber 40. The wave guide 50 can be provided in a variety of ways as are known in the art. For example, aluminum or brass tubing can be used as a wave guide 50 to direct energy from the energy source 30 to the chamber 40. Suitable wave guides are available from Richardson Electronics, LTD., having offices in LaFox, Ill.

The microwave apparatus 20 of the present invention may also include an aperture plate 52 intermediate the wave guide 50 and the chamber 40. For example, as representatively illustrated in FIG. 2, the aperture plate 52 is sandwiched between the wave guide 50 and the exterior surface of the chamber 40. The aperture plate 52 includes an aperture 54 that, when properly sized can also shift the frequency of the energy to a desired level, thereby helping to reduce the amount of variable tuning adjustments that may be needed, particularly when processing a continuously moving web of material 22. The aperture plate 52 may be fabricated from various suitable materials that are known in the art such as aluminum, copper, brass, bronze, gold and silver, as well as combinations thereof. As can be readily understood by those of ordinary skill in the art, the aperture plate 52 may be selected and configured to help tune the microwave apparatus 20 to a particular material 22 or product that is being processed.

As mentioned above, the various aspects of the microwave apparatus 20 and method of the present invention also includes a chamber 40. In the various aspects of the present invention, the target material 22 is fed into the chamber 40 and is exposed to the microwave energy within the chamber 40.

The chamber 40 may be a variety of configurations and shapes. The chamber 40 may be cylindrical, rectangular, or other various shapes as are known in the art or combinations thereof. For example, as representatively illustrated in FIGS. 1–4, the chamber 40 has a rectangular exterior shape having a generally cylindrically shaped interior. In such a configuration, the chamber 40 defines a substantially circular cross section, which allows for the chamber to more readily maintain different resonant electromagnetic modes, particularly modes which can more readily and uniformly fill the entire chamber 40.

As representatively illustrated in FIGS. 1–4, the chamber 40 includes a static wall portion 42 and a flexible wall 44. In a particular aspect, the chamber 40 of the present invention can include a plurality of flexible walls 44. For example, the chamber 40 can include first and second opposed flexible walls 44. The static wall portion 42 of the chamber 40 can be any part of the structure of the chamber 40 that does not move and remains in a constant, fixed position. For example, as representatively illustrated in FIGS. 1–4, the static wall portion 42 can be provided by the fixed walls 43. Alternatively, the static wall portion 42 can be provided by a framework or structure of the chamber 40.

Each of the flexible walls 44 of the chamber 40 defines a flexible portion 46 and a perimeter portion 48. The flexible walls 44 can be any part of the chamber 40 that includes a portion that is configured to be displaced or moved (i.e., the flexible portion 46) and a perimeter portion 48 that surrounds or circumscribes the flexible portion 46 that is configured not to move (i.e., remain fixed or static) relative to the other portions of the chamber 40. The flexible portion 46 can be integral with the perimeter portion 48 to provide the flexible wall 44, or they may be separate elements that are attached together to provide the flexible wall 44.

In particular, the perimeter portion 48 of the flexible wall 44 is statically joined to the static wall portion 42 of the chamber 40 such that it remains fixed when the flexible portion 46 is moved or displaced. As representatively illustrated in FIGS. 1–4, the flexible walls 44 may be provided by the end walls 45 of the chamber 40. Alternatively, and depending on the shape and/or configuration of the chamber 40, the flexible wall 44 can be provided by another portion or wall of the structure of the chamber 40.

The chamber 40 further includes a chamber interior surface 62, a chamber exterior surface 64 opposite the interior surface 62 and a chamber volume 60 that is defined by the space delimited by the chamber interior surface 62. In the various aspects of the microwave apparatus 20 and method of the present invention, at least a portion of the flexible wall 44 provides a portion of the chamber interior surface 62. In particular, at least the flexible portion 46 of the flexible wall 44 provides a portion of the chamber interior surface 62. Moreover, as representatively illustrated in FIGS. 1–4, the static wall portion 42 can optionally provide at least a portion of the chamber exterior surface 64 and the chamber interior surface 62. Similarly, along with providing at least a portion of the chamber interior surface 62, the flexible wall 44 may optionally provide a portion of the chamber exterior surface 64.

The chamber 40 may be constructed of materials as are known to those skilled in the art. For example, the chamber 40 may be constructed of aluminum, copper, brass, bronze, gold, silver, composite materials, as well as combinations thereof and the like, or combinations thereof. In particular, the flexible wall 44 may be aluminum with the flexible portion 46 being 22 Gauge (0.6426 mm) thickness for suitable flexibility and durability. Similarly, in a particular aspect, the static wall portion may be 6061 aluminum material.

The chamber 40 may be assembled by methods known in the art. For instance, the components of the chamber 40 may be bolted, riveted, welded, and the like or combinations thereof. In particular, the perimeter portion 48 of the flexible wall 44 may be statically joined to the static wall 42 using bolts distributed evenly over the perimeter portion 48 to reduce the possibility of undesirable movement between the perimeter portion 48 and the static wall 42, which in turn will decrease the likelihood of arcing within the chamber 40. In particular aspects, portions of the chamber 40 may be assembled together using quick release latches 72. The latches can securely and fixedly join portions of the chamber 40 together, while readily allowing access to the interior of the chamber 40. This access can ease cleaning and maintenance of the chamber 40. Suitable latches are well known in the art and for example may be toggle clamps available from De-Sta-Co Industries, Inc., having offices in Madison Heights, Mich.

The microwave apparatus 20 and method of the present invention can further includes an actuator 80 operatively connected to the flexible portion 46 of each flexible wall 44. For example, as representatively illustrated in FIGS. 1–4, each of the first and second opposed flexible walls 44 have an actuator 80 operatively connected to their respective flexible portions 46. Alternatively, a single actuator 80 can be operatively connected to multiple flexible portions 46 of multiple flexible walls 44. The actuator 80 can be configured to move the flexible portion 46 (while the perimeter portion 48 remains fixed) and as a result change the chamber volume 60. Accordingly, the chamber may be tuned by way of changing the chamber volume 60 as necessary to accommodate changes in the target material 22 or other variables which may dictate tuning of the chamber 40. In particular, the flexible portion 46 may be capable of moving between 0.5 to 10 mm in a first direction from its initial unadjusted position to decrease the chamber volume 60. Similarly, the flexible portion 46 may also be capable of moving between 0.5 to 10 mm in a second direction, opposite from the first direction, from its initial unadjusted position to increase the chamber volume 60.

The actuator 80 can be any device that is capable of displacing or moving the flexible portion 46 of the flexible wall 44 as are well known to those skilled in the art, such as a linear motor or a linear actuator. Desirably, the actuator 80 is capable of moving the flexible portion 46 in fine increments (less than 1 mm, suitably less than 0.5 mm, more suitably less than 0.25 mm, still more suitably less than 0.1 mm, and still yet more suitably less than 0.05 mm) for improved tuning performance. Further, in configurations where there are first and second flexible walls 44 and first and second actuators 80, the actuators can be configured to move the flexible portions 46 an equal amount and simultaneously. Alternatively, the first and second actuators 80 can be configured to move in unequal amounts or in an alternating fashion rather than simultaneously.

In addition, the actuator 80 can suitably have a short response time. That is, the actuator 80 can quickly move the flexible portion 46 upon recognition that an adjustment is necessary. In particular, the response time is desirably less than 1 second, more desirably less than 0.5 seconds, and still more desirably less than 0.25 seconds. Moreover, the actuator 80 is suitably capable of maintaining the position of the flexible portion 46 following movement or displacement. Further, the actuator 80 can suitably move the flexible portion 44 at least 20 mm.

In a particular aspect, the actuator 80 can be a servo motor. Suitable servo motors are well known in the art and are available from Exlar Corporation having offices in Chanhassen, Minn. Alternatively, the actuator 80 can be a voice coil. In such a configuration, the voice coil can utilize a magnetic field to move and maintain the flexible portion of the flexible wall in a desired position. In particular, LA43-46-000A voice coil from BEI, Kimco Magnetics having offices in San Marcos, Calif. is an example of a voice coil suitable for use with the present invention. In yet another alternative, the actuator 80 can be a vacuum/pressure system that relies on a pressure differential across the flexible wall to move and maintain the flexible portion of the flexible wall in a desired position.

The chamber 40 can further include a material inlet 66 and a material outlet 68 for admitting the materials intended to be processed into the chamber 40 and for providing an exit for the materials from the chamber 40. The inlet and outlet 66 and 68 can be suitably sized and configured to allow an operative movement of the desired material through the chamber 40 while also avoiding excessive leakage of energy from the chamber.

In particular aspects where the materials to be processed by the microwave apparatus 20 are such that the material inlet 66 and material outlet 68 are large enough for undesirable energy leakage to occur, a choke 70 may be utilized on the material inlet 66 and/or outlet 68 (FIG. 1). Chokes 70 are well known to those skilled in the art and are configured to prevent energy leakage from openings in the chamber such as the inlet and outlet 66 and 68. Chokes 70 can rely on geometry, an array of pins on the interior of the choke, or a combination thereof in order to prevent energy leakage from the microwave apparatus 20. Suitably, the chokes 70 of the present invention are connected to the chamber 40 such that there are no gaps or component on component movement that can result in undesirable arcing.

The chamber 40 of the microwave apparatus 20 of the present invention can further define a material path through the chamber 40 as indicated by the arrow marked 24. For instance and as representatively illustrated in FIG. 1, the material path 24 can be a substantially straight line passing into and through the material inlet 66 and continuing through the material outlet 68. In particular aspects of the apparatus 20 and method of the present invention, the chamber volume 60 can be symmetrical about the material path 24. Specifically, the chamber volume 60 is divided substantially equally about the material path. In such a configuration, the energy, which is desirably in the form of a standing wave, will be focused upon the target material 22 as it travels along the material path 24 to maximize the efficiency of the method and apparatus 20.

Moreover, the chamber volume 60 can suitably remain symmetrical about the material path 24 upon movement of the flexible portion 46 of the flexible wall 44. For example, in aspects where the chamber 40 includes first and second opposed flexible walls (FIGS. 1–4) each of the flexible portions 46 can be moved by the first and second actuators 80 an equal amount thereby maintaining symmetry about the material path 24. As such, even as the chamber volume 60 changes (i.e., increases or decreases) to tune the apparatus 20, the energy will remain focused on the target material 22 traveling on the material path 24.

In the various configurations of the method and apparatus 20 the chamber 40 can have various dimensions to provide the material 22 with the desired residence time within the chamber 40. For example, the chamber 40 can be at least about 8 cm up to about 25 cm or even up to about 50 cm or more in the direction of the material path 24. Accordingly, the total residence time within the chamber 40 can be at least a minimum of about 0.002 sec. The residence time can alternatively be at least about 0.005 sec, and can optionally be at least about 0.01 sec to provide improved performance. In other aspects, the residence time can be up to a maximum of about 3 sec. The residence time can alternatively be up to about 2 sec, and can optionally be up to about 1.5 sec to provide improved effectiveness.

Materials to be processed by the apparatus 20 of the present invention can be guided through the chamber 40 along the material path 24 by various means as are known in the art. For example, a conveyor (not shown) may be used to feed materials to be processed into and out of the chamber 40 through the material inlet and outlet 66 and 68. In such an aspect, the conveyor belt suitably can be constructed from materials that do not absorb or minimally absorb microwave energy, such as fiberglass, polypropylene nonwovens, and the like or combinations thereof.

This configuration of the method and apparatus 20 of the present invention allows the chamber volume 60 to be modified in response to load changes that may occur while processing materials with the microwave apparatus 20. For example, material density, size, or the mixture of components within a material that is being processed can change as a continuous web of material or a web of individual material portions are passed through the microwave apparatus 20. Thus, the chamber volume 60 can be modified by moving the flexible portion 46 of the flexible wall 44 even while materials are being processed, to adjust the resonant frequency of the chamber 40 to most efficiently process materials with the microwave apparatus 20 as moving the flexible portion 46 of the flexible wall 44 changes the amount of energy being absorbed by the material 22.

The microwave apparatus 20 can optionally include a feedback system (generally indicated at 90) that is capable of controlling the actuators and automatically adjust the chamber volume 60 by way of moving the flexible portions 46 of the flexible walls 44. As such, the feedback loop 90 can respond to changes in the material 22 being processed by the microwave apparatus 20 to improve the efficiency in the amount of energy being absorbed by the material 22 in the apparatus 20. For example, as representatively illustrated in FIG. 1, the feedback loop 90 can include an energy sensor 92 and a controller 94. In a particular aspect, the sensor 92 may be located within the chamber 40 such that it can sense the level of energy that is not being absorbed by the materials 22 being processed (i.e., the reflected energy). Alternatively, a sensor 92 could be located external to the chamber 40 and be positioned to sense the energy level within the chamber through one of the material inlet or outlet 66 or 68. The controller 94 can optionally be linked to both the sensor 92 and the actuator 80. As such, the controller 94 can utilize the data provided by the sensor 92 and be programmed to use the actuators 80 to move the flexible portions 46 of the flexible wall 44 and change the chamber volume 60.

As a result, the feedback system 90 can also be used to measure the effectiveness of the microwave apparatus 20 by measuring the energy that is reflected back from the target material 22 in the chamber 40. In a particular aspect, the method and apparatus 20 can be configured to provide a reflected energy that is not more than a maximum of about 50% of the energy that is delivered to the material 22. The reflected power can alternatively be not more than about 20% of the delivered energy, and can optionally be not more than about 10% of the delivered energy to provide improved performance. In a desired feature, the reflected energy can be substantially zero. The reflected energy can alternatively be about 1% or less of the delivered energy, and can optionally be about 5% or less of the delivered energy to provide desired benefits.

A suitable measuring system for measuring the reflected power can be detected with a conventional power sensor, and can be displayed on a conventional power meter. The reflected power may, for example, be detected at the location of an isolator. The isolator is a conventional, commercially available device which is employed to protect an energy source 30 from reflected energy. Typically, the isolator is placed between the energy source 30 and the wave guide. Suitable power sensors and power meters are available from commercial vendors. For example, a suitable power sensor can be provided by a HP E4412 CW power sensor which is available from Agilent Technologies, a business having offices located in Brookfield, Wis., U.S.A. A suitable power meter can be provided by a HP E4419B power meter, also available from Agilent Technologies.

The controller can be any computer that can be suitably programmed and otherwise configured to accept data from the sensor 92 and operate the actuator. For example, the controller 94 can be a programmable logic controller such as an Allen Bradley CONTROL LOGIX 5550 or a RELIANCE® AUTOMAX® Programmable Controller, both available from Rockwell Automation, Milwaukee, Wis.

Accordingly, the method and apparatus of the present invention provides an improved method and apparatus for processing materials with microwave energy. In particular, the method and apparatus of the present invention is suitable for use with materials having constituent parts with different dielectric constants. An example of such a material is an absorbent body that may be suitable for use in a disposable absorbent article, such as a disposable diaper, training pant, incontinence article, feminine pad, and the like. Such articles are described in U.S. Pat. No. 5,827,259 issued Oct. 27, 1998 to Laux et al.; U.S. Pat. No. 5,853,402 issued Dec. 29, 1998 to Faulks et al.; U.S. Pat. No. 4,940,464 issued Jul. 10, 1990 to Van Gompel et al.; and U.S. Pat. No. 6,645,190 issued Nov. 11, 2003 to Olson et al. which are incorporated herein by reference to the extent that they are consistent (i.e., not in conflict) herewith.

In particular, the web of absorbent material can optionally include absorbent fiber, superabsorbent material, or binder fiber, or a combination thereof. For example, the web can include a matrix of absorbent fibers, and more suitably cellulosic fluff, such as wood pulp fluff, and superabsorbent particles. An example of pulp fluff is identified with the trade designation CR1654, commercially available from U.S. Alliance, Childersburg, Ala., U.S.A. Superabsorbent materials can be selected from natural, synthetic, and modified natural polymers and materials. Suitable superabsorbent materials are available from various commercial vendors, such as Dow Chemical Company of Midland, Mich., U.S.A., and Stockhausen Inc., Greensboro, N.C., U.S.A. Suitable binder fibers for use in absorbent structures are available from KoSa, having offices in Houston, Tex., Chisso Corporation, having offices in Tokyo, Japan, and Trevira GmbH, having offices in Bobingen, Germany.

Thus, in such an aspect, the method and apparatus of the present invention can be used to activate the binder fiber material and operatively provide a plurality of interconnections between the absorbent fibers and binder-fibers that are dispersed within the absorbent material. In a particular arrangement, the microwave energy or other electromagnetic energy in the chamber can operatively heat the binder fibers to a temperature above the melting point of the binder fiber material (i.e., activate the binder fiber). The melted binder fibers can then adhere or otherwise bond and operatively connect to the other absorbent fibers. Additionally, the binder-fibers can operatively adhere or otherwise bond and interconnect with superabsorbent material that can be present within the material. Suitably, the method and apparatus can rapidly activate the binder fiber while substantially avoiding any scorching or burning of the other components of the absorbent material.

The material to be processed may be provided in the form of a continuous web of interconnected material, such as a continuous web of absorbent material, or it may be provided in the form of a web of intermittent bodies of material, such as a series of individual absorbent bodies connected by a web of tissue, nonwoven, or other carrier material. The web of material, whether continuous or a series of individual bodies can define a web direction (indicated at the arrow marked 26) that extends parallel to the material path 24. As representatively illustrated in FIG. 1, the web of material 22 can change shape along the web direction 26. Moreover, the web of material can change density along the web direction 26. Further, and as described in greater detail below, the web of material 22 can include multiple materials having different dielectric constants. Still further, the web of material 22 can reflect a combination of these attributes. Accordingly, such a web of material can benefit from the microwave apparatus 20 and method of the present invention where the chamber 40 can be readily tuned to accommodate these changes to the target material 22.

Further, as described above, the chamber volume of the chamber 40 of the present invention can be modified while not relying on the components of the chamber slidably moving against each other or gapping from each other. In particular, this configuration advantageously can help reduce the amount of arcing between parts of the chamber 40. As discussed above, arcing is an undesirable effect when processing materials in an electromagnetic device, and can result in the materials being processed to burn or to ignite.

As various changes could be made in the above constructions and methods, without departing from the scope of the invention, it is intended that all matter contained in the above description and shown in the accompanying drawings shall be interpreted as illustrative and not in a limiting sense.

When introducing elements of the invention or the preferred aspect(s) thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A microwave apparatus comprising:

an electromagnetic energy source; and a chamber operatively connected to said electromagnetic energy source, said chamber defining a chamber volume and a material path through said chamber wherein said chamber volume is symmetrical about said material path; said chamber comprising:

a static wall portion;

a flexible wall defining a flexible portion and a perimeter portion, said perimeter portion statically joined to said static wall portion; and an actuator operatively connected to said flexible portion and configured to move said flexible portion and change said chamber volume wherein said chamber volume remains symmetrical about said material path upon movement of said flexible portion.

2. The apparatus of claim 1 wherein said chamber comprises first and second opposed flexible walls, each flexible wall defining a flexible portion and a perimeter portion, said perimeter portions statically joined to said static wall portion; and first and second actuators joined to said flexible portions and configured to move said flexible portions and change said chamber volume.

3. The apparatus of claim 2 wherein said first and second actuators move said flexible portions an equal amount.

4. The apparatus of claim 2 wherein said chamber further defines a material path through said chamber and wherein upon movement of said first and second flexible portions, said chamber volume remains symmetrical about said material path.

5. The apparatus of claim 1 wherein said actuator is a servo motor.

6. The apparatus of claim 1 wherein said actuator is a voice coil.

7. The apparatus of claim 1 wherein said flexible portion moves between 0.5 to 10 mm.

8. A method for processing a material with microwave energy, said method comprising:

feeding a material into a chamber defining a chamber volume and a material path through said chamber, said chamber comprising a static wall and a flexible wall defining a flexible portion and a perimeter portion;

exposing said material to microwave energy within said chamber; and moving said flexible portion while said perimeter portion remains fixed to said static wall portion whereby said chamber volume is changed and said chamber volume remains symmetrical about said material path.

9. The method of claim 8 wherein moving said flexible portion changes the amount of energy being absorbed by said material.

10. The method of claim 8 wherein said flexible portion is moved by a servo motor.

11. The method of claim 8 wherein said flexible portion is moved by a voice coil.

12. The method of claim 8 wherein said material is a continuous web of material defining a web direction.

13. The method of claim 12 wherein said continuous web of material changes shape along said web direction.

14. The method of claim 12 wherein said continuous web of material changes density along said web direction.

15. The method of claim 12 wherein said continuous web of material comprises multiple materials having different dielectric constants.

16. The method of claim 8 wherein said flexible wall is moved between 0.5–10 mm.

17. The method of claim 8 wherein said chamber comprises first and second opposed flexible walls.

18. A method of tuning a microwave apparatus, said method comprising:

providing a chamber for exposing materials to microwave energy, said chamber defining a chamber volume, a material path through said chamber volume and comprising at least one flexible wall; and changing said chamber volume by moving said flexible wall such that said chamber volume remains symmetrical about said material path.

19. The method of claim 18 wherein said chamber comprises first and second opposed flexible walls.

20. The method of claim 19 wherein said first and second opposed flexible walls each define a flexible portion and a perimeter portion wherein said perimeter portions remain static while said flexible portions move.

* * * * *